United States Patent [19]

Friedli et al.

[11] 4,328,085

[45] May 4, 1982

[54] DEVICE FOR SERVICING ELECTROLYTIC CELLS

[75] Inventors: Hans Friedli; Edwin Gut; Peter Aeschbach, all of Steg, Switzerland

[73] Assignee: Swiss Aluminium Ltd., Chippis, Switzerland

[21] Appl. No.: 184,345

[22] Filed: Sep. 5, 1980

[30] Foreign Application Priority Data

Sep. 10, 1979 [CH] Switzerland ..... 8146/79

[51] Int. Cl.[3] ..... C25C 3/14

[52] U.S. Cl. ..... 204/245

[58] Field of Search ..... 204/67, 243 R, 244–247

[56] References Cited

U.S. PATENT DOCUMENTS

| | | | |
|---|---|---|---|
| 3,186,927 | 1/1965 | Mantovanello | 204/245 X |
| 3,371,026 | 2/1968 | Kiley et al. | 204/245 |
| 3,551,308 | 12/1970 | Capitaine et al. | 204/246 X |
| 3,616,439 | 10/1971 | Love | 204/245 X |
| 3,664,946 | 5/1972 | Schaper et al. | 204/245 X |
| 3,679,555 | 7/1972 | Duclaux et al. | 204/245 X |
| 3,769,195 | 10/1973 | Weterings | 204/245 X |
| 3,901,787 | 8/1975 | Niizeki et al. | 204/245 X |
| 3,977,950 | 8/1976 | Tortil | 204/246 X |
| 4,049,529 | 9/1977 | Golla | 204/246 |
| 4,053,384 | 10/1977 | Siegmund | 204/245 X |

*Primary Examiner*—Delbert E. Gantz
*Assistant Examiner*—Donald R. Valentine
*Attorney, Agent, or Firm*—Bachman and LaPointe

[57] ABSTRACT

The invention relates to a device for point feeding an electrolytic cell, in particular a cell for producing aluminum. A point feeder unit comprising a raw materials feeding device and a crust breaking facility releasably mounted on a storage bunker is mounted on a beam, can be freely displaced along and/or across the cell and can be removed in the vertical direction with a crane.

32 Claims, 14 Drawing Figures

DEVICE FOR SERVICING ELECTROLYTIC CELLS

BACKGROUND OF THE INVENTION

The present invention relates to a device for point feeding or servicing an electrolytic cell, in particular a cell for producing aluminum.

In the manufacture of aluminum from aluminum oxide the latter is dissolved in a fluoride melt made up for the greater part of cryolite. The aluminum which separates out at the cathode collects under the fluoride melt on the carbon floor of the cell; the surface of this liquid aluminum acts as the cathode. Dipping into the melt from above are anodes which, in the conventional reduction process, are made of amorphous carbon. As a result of the electrolytic decomposition of the aluminum oxide, oxygen is produced at the carbon anodes; this oxygen combines with the carbon in the anodes to form $CO_2$ and CO. The electrolytic process takes place in a temperature range of approximately 940°–970° C.

The concentration of aluminum oxide decreases in the course of the process. At an $Al_2O_3$ concentration of 1–2 wt.% the so-called anode effect occurs producing an increase in voltage from e.g. 4–4.5 V to 30 V and more. At this time at the latest the crust must be broken open and the concentration of aluminum oxide increased by adding more alumina to the cell. Under normal operating conditions the cell is fed with aluminum oxide regularly, even when no anode effect occurs. Also, whenever the anode effect occurs the crust must be broken open and the alumina concentration increased by the addition of more aluminum oxide, which is called servicing the cell.

For many years now servicing the cell includes breaking open the crust of solidified melt between the anodes and the side ledge of the cell, and then adding fresh aluminum oxide. This process which is still widely practiced today is finding increasing criticism because of the pollution of the air in the pot room and the air outside. In recent years therefore it has become increasingly necessary and obligatory to hood over or encapsulate the reduction cells and to treat the exhaust gases. It is however not possible to capture completely all the exhaust gases by hooding the cells if the cells are serviced in the classical manner between the anodes and the side ledge of the cells.

More recently therefore aluminum producers have been going over to servicing at the longitudinal axis of the cell. After breaking open the crust, the alumina is fed to the cell either locally and continuously according to the point feeder principle or discontinuously along the whole of the central axis of the cell. In both cases a storage bunker for alumina is provided above the cell. The same applies for the transverse cell feeding proposed recently by the applicant (U.S. Pat. No. 4,172,018).

The numerous known point feeder systems e.g. German Pat. No. 2 135 485 and U.S. Pat. No. 3,371,026 or the elements thereof are mounted rigidly onto the cell superstructure. This has the disadvantage that repairs to the device and changing parts is often complicated and time-consuming. Furthermore, the alumina can not always be fed to the best position in the molten electrolyte.

It is therefore a principal object of the present invention to develop a device for point feeding an electrolytic cell, and namely such that the said device is easy to service i.e. feed, that it ensures the alumina is fed to the best position, and that it can be built on to existing cells without great expenditure.

SUMMARY OF THE INVENTION

The foregoing object is achieved by way of the present invention in the form of a point feeder unit which can be slid freely on a beam in the longitudinal and/or transverse direction and can be removed vertically by means of a crane, the feeder unit being made up of:

(a) a feeding device, comprising a storage bunker with a large container for alumina and a small container for additives, a dosing device and a run-out pipe which can always be extended in a telescopic manner to the place where the crust has to be broken open, and (b) a crust breaking facility which is secured releasably to the storage bunker by a suspension means, can be raised separately in the vertical direction and comprises a pressure cylinder system, a chisel and a housing with chisel alignment means secured to a lower flange on the pressure cylinder.

Two such point feeder units on a fixed cross beam arranged on the anode supports are preferred for each cell. The freedom of movement of the units in the longitudinal and/or transverse direction is limited solely by the hooding on the cell.

The point feeder units are provided at the top with hooks. The feeder units can easily be raised with a crane and likewise can be replaced by another unit in a very short time. If necessary, the crust breaker can be removed or replaced separately.

BRIEF DESCRIPTION OF THE DRAWING

The present invention will now be explained in greater detail with the help of schematic drawings of the exemplified embodiments wherein.

DETAILED DESCRIPTION

Figure 1:
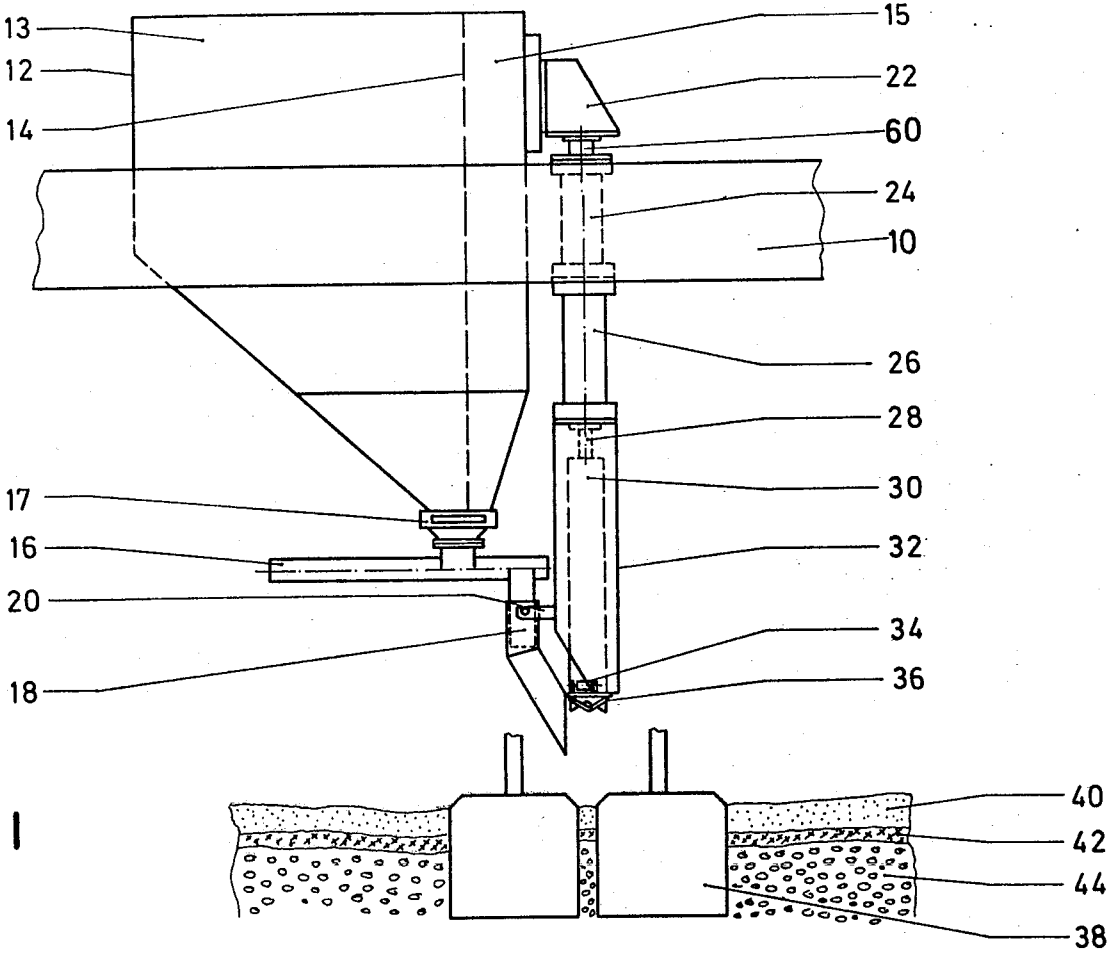
FIG. 1: Is a view of a point feed unit mounted on a beam.

FIG. 1 shows a point feeder unit which is shown later in detail as a whole. The unit can be dismounted from beam 10 and raised up by means of a crane and hooks on the storage bunker 12 which are not shown here. The crust breaking facility comprising the pressure cylinder system 24,26, the chisel 30 and the alignment housing 32 is releasably mounted on the storage bunker 12 and can also be raised separately by a crane. Below the point feeder unit are carbon anodes 38, the alumina 40 which has been poured onto the crust 42 and the molten electrolyte 44.

Also shown in FIG. 1 is a storage bunker 12 with a large container 13 for alumina and a small container 15 for additives such as e.g. cryolite, aluminum fluoride and ground electrolyte crust. Both containers are separated by a flat, vertical dividing wall 14. The alumina bunker 12 in FIG. 2 differs in its subdivision into a large container 13 and a small container 15. The small container 15 is delimited by a tube wall 54. In both cases, with the flat dividing wall or with the tube-shaped container, the volume of the small container preferably amounts to 0.5–25 vol.%, in particular 5–20 vol.% of the volume of the whole storage bunker 12.

The sliding plate valve 17 which delimits the storage bunker 12 at the bottom can be in one or two parts. The two-part plate 17 which is provided at the bottom of the dividing wall 14 can be employed for mixing the charge in that both halves can be withdrawn to varying degrees depending on the amount to be fed from each compartment of the storage bunker.

At the bottom of the storage bunker there is a flange which is connected to the dosing facility 16. This dosing facility is for example, in accordance with one of the versions described in the U.S. patent application Ser. No. 124,598 in the form of an alumina drawer. A piston arrangement pushes per stroke a specific amount of alumina or additives e.g. 1 kg into the outlet pipe 18. The material pushed out falls, via the lower, inclined part of the outlet pipe, onto the part of the crust broken open by the chisel.

Usefully the feed pipe, which is supplied with alumina and/or additives, branches just before or immediately after it enters a storage bunker which is fitted with a top sheet. One end of the branched feed pipe is situated over the large container for the alumina and is provided with a plurality of outlets. The other branch of the feed pipe terminates over the small container for the additives and is, depending on the dimensions of this small container, provided with one or more outlets. Both end pieces of the feed pipe lie preferably on a horizontal plane. At the branching point or just after that suitable diversion or blocking facilities are provided; these allow the following modes of supplying the containers in the storage bunker:

(a) the material being supplied flows through both end pieces into both containers, (b) the material being supplied flows through one end piece into the large container, (c) the material being supplied flows through one end piece into the large or the small container, (d) both end pieces are closed to the material in the feed pipe.

Figure 2:
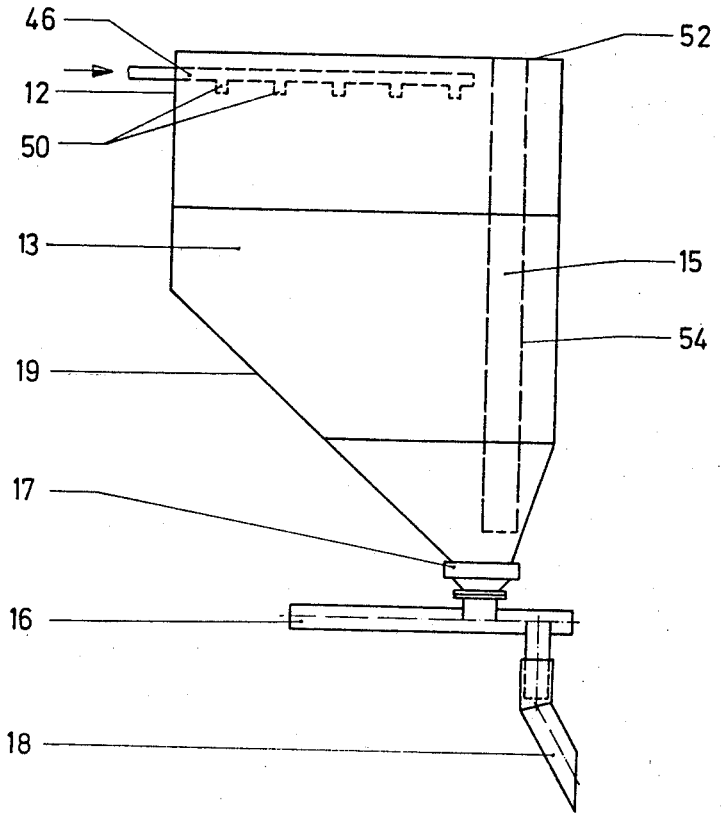
FIG. 2: Is a view of a feeding system with end piece of the feed pipe inside the storage bunker.

According to the version in FIG. 2 one end of the supply pipe 46 from the pressurized chamber to the large container 13 is shown in the upper part of the storage bunker 12 which is provided with a top sheet 52. The alumina enters the large container through outlets 50. The other end piece with the outlet over the small container is not shown here.

If the electrolyte has been depleted of additives and, for example, has become alkaline or too acidic, and both containers are full of alumina, then the sliding valve 17 is set such that only the alumina in the small container flows out. The end piece for the alumina is closed, the necessary additives charged into the pressurized chamber and passed along the supply pipe 46 into the small container 15 via the appropriate outlets. With the sliding valve 17 open for the small container the additives, if desired with some alumina, are fed to the cell via the dosing facility 16 and the outlet pipe 18. This method is, however, useful only when the volume of the small container is small compared with the volume of the storage bunker as a whole, as, otherwise, there could be a long delay before the additives reach the cell due to the length of time to empty the container.

When charging with alumina, therefore, the outlet from or the inlet opening to the small container 15 can be closed, so that all the alumina is charged to the large container 13. The small container 15 remains empty and can be used any time to supply the bath quickly with additives.

The inclination of wall 19 of the container 13 must be at least such that even the poorest flowing material will flow down it.

Any mixture of alumina and additives, if desired, can be achieved not only by means of a two-part sliding valve 17, but also by raising pipe 54.

With all versions of the storage bunker the steps in the process, for supplying alumina and additives, for setting the sliding valve 17 and for operating the dosing facility 16 are initiated and controlled by means of a central data processing unit.

The design of the storage bunker according to the present invention has the advantage that the additives can be fed to the bath at any time, quickly, in any amount desired and in a closedoff system of material flow. This means that the hooding on the cell does not need to be opened, the regular feeding from the silo is not interrupted and no separate feed pipe with separate compression chamber need be constructed.

Figure 3:
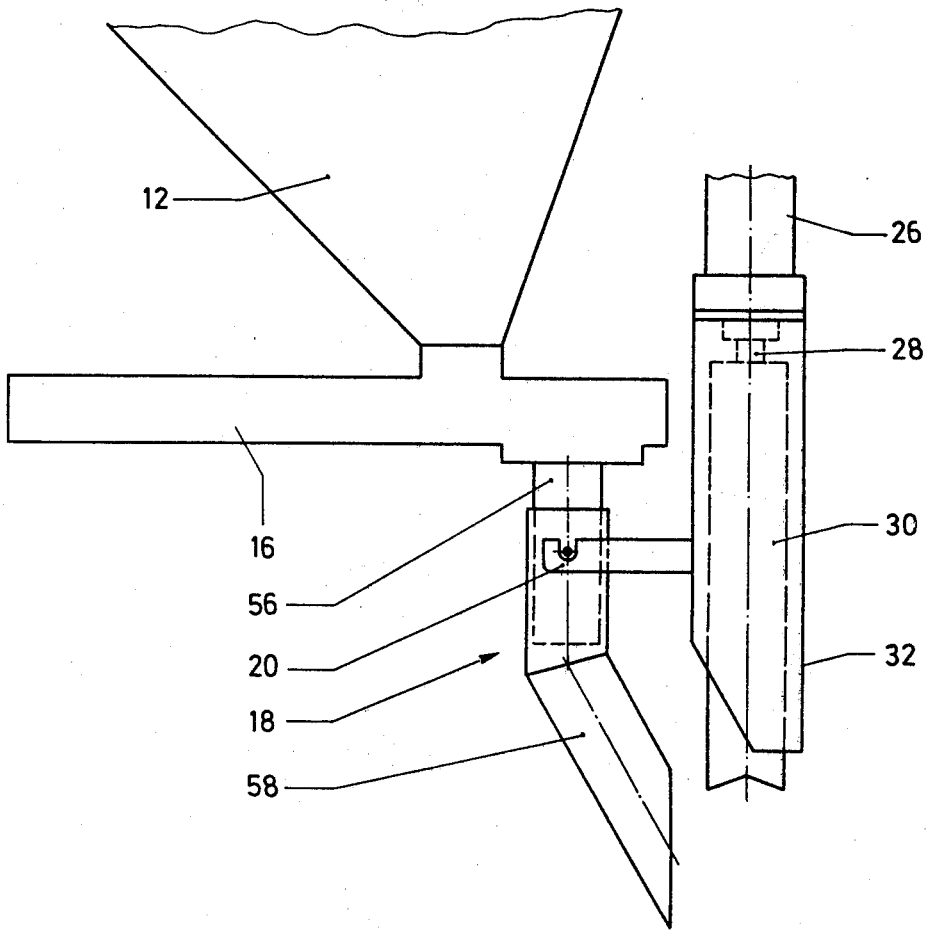
FIG. 3: Is a view of a mobile run-out pipe attached to the alignment housing.

FIG. 3 shows the connection between the movement of the working cylinder 26 and the outlet pipe 18 which is telescopic in design. The housing 32 for the alignment of the chisel 30 secured to the piston rod 28 of the pressure cylinder is mounted, preferably air-tight, on the lower flange of the pressure cylinder 26. The lower, mobile part of the outlet pipe is suspended from the mechanically stable housing 32 via a support arm 20. The upper, stationary part 56 which is attached to the dosing facility has a smaller diameter so that the mobile part 58 can be slid over it like a sleeve.

When the crust breaker is in the non-operating position—not shown in FIG. 3—the mobile part 58 of the alumina outlet pipe fits completely over the fixed, stationary pipe length 56. If the pressure cylinder 26 is lowered into the position for working the support 20 attached to the housing 32 is lowered also and with it the mobile pipe length 58 the same distance. This design ensures that the alumina is always fed to the same place and that the outlet pipe, when not in use, e.g. during anode changes, is raised out of the way. In the position ready for working—as is shown in FIG. 3—the chisel 30 is drawn up inside the housing. In the working position, however, the chisel 30, but not the housing 32, is lowered.

Figure 4:
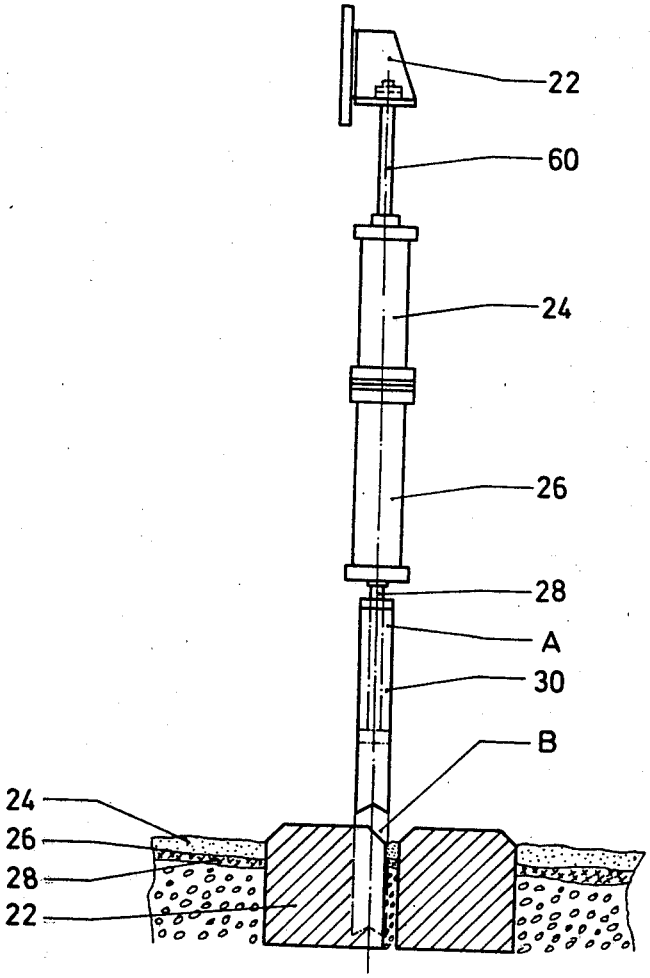
FIG. 4: Is a view of a pressure cylinder system of a crust breaking facility in the position ready for operation, shown here partly in cross section.

The crust breaking facility in FIGS. 1 and 4 comprising a pressure cylinder system with two cylinders is secured to the suspension means 22. The piston rod 60 in the positioning cylinder 24 is releasably connected to the suspension means 22 by means of an upper flange e.g. by bolts. The lower flange of the positioning cylinder 54 and the upper flange of the working cylinder 26 are likewise joined together mechanically, permanently or releasably so. Provided in the working cylinder 26 is a piston rod 28 which can be driven downwards and which carries the chisel 30 for breaking open the crust.

The sequence of operation of the crust breaker powered by the pressure cylinder system can be described schematically as follows:

1. The piston rods 60, 28 of the positioning and working cylinders respectively are in the withdrawn position when the crust breaker is not in operation. This is the position required for anode changes when the chisel 30, for physical reasons, and the working cylinder 26, for thermal reasons, must be kept as far as possible from the anodes, and for working on the crust breaker i.e. when the suspension means 22 is freed from the beam. This non-operative position is shown in FIG. 1.

2. FIG. 4 on the other hand shows the extended piston rod 60 of the positioning cylinder 24; the crust breaker is ready for operation. The piston rod 28 of the working cylinder 26 is still withdrawn but ready for working. Position A in FIG. 4 shows the starting position for maintaining an opening in the crust in order that alumina can be fed to the cell.

3. In FIG. 4, position B, the piston rod 28 of the working cylinder 26 is shown extended and the crust has been broken open by the chisel 30 which has been lowered to the end of the stroke of the working cylinder. After reaching this position, the chisel, having broken through the crust, is made to reverse its direction of movement. The return of the chisel or piston from the lower position is initiated pneumatically or by position sensors. This working sequence is repeated according to a specific program. Should the piston not reach the end position, it is returned after a predetermined interval.

In the case of the other arrangement for mounting the crust breaker—not shown here—in which the upper flange of the positioning cylinder 24 is releasably attached to the suspension means 22, the sequence of operation is in principle the same. The only difference is that the piston rod 60 is lowered and not the positioning cylinder 24 as shown in FIG. 4.

Figure 5:
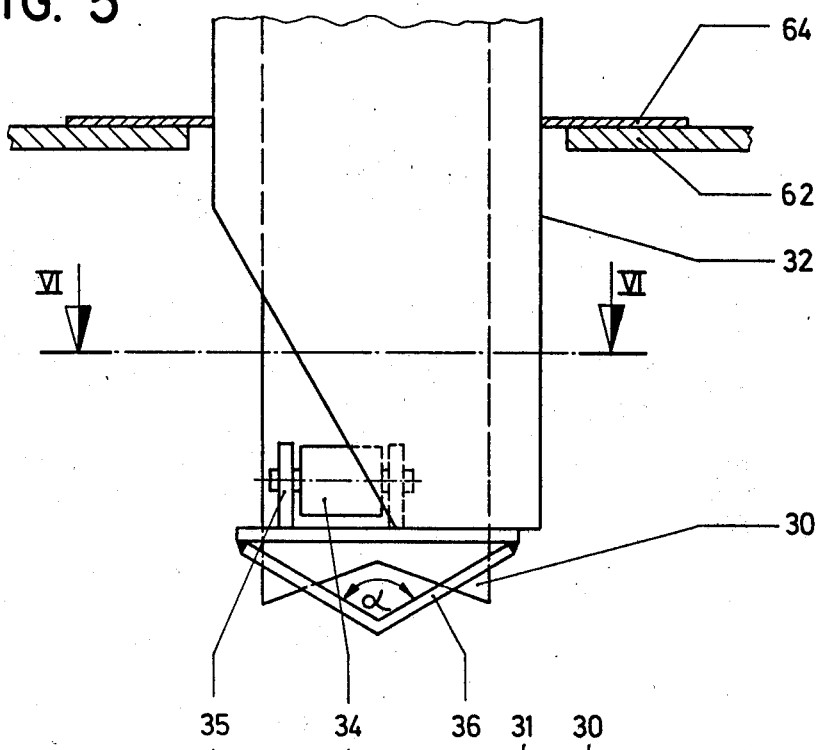
FIG. 5: Is a vertical, longitudinal section with a view through part of the lower region of a crust breaker in the non-operating position, shown here with a chisel alignment device.
Figure 6:
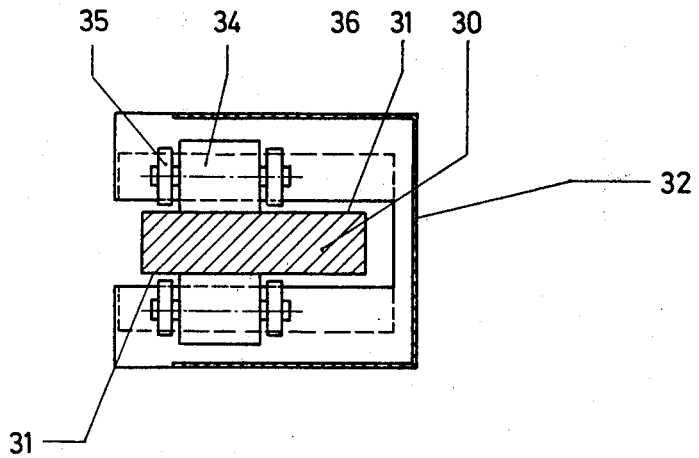
FIG. 6: Is a horizontal section through line VI—VI in FIG. 5.

The total length of stroke between the working and non-working position of the chisel 30 on the working cylinder piston rod 28 is divided between the poitioning and working cylinders in a manner depending on the geometry of the electrolytic cell. If the total length of stroke is ca. 900 mm, the positioning cylinder can have a stroke of 300 to 500 mm and the working cylinder a stroke of 400–600 mm. FIGS. 5 and 6 show a square shaped alignment box 32 made of steel sheet. The chisel 30, in this case fish-tail-shaped, passes through this box. Two parallel alignment faces 31 on opposite broad sides of the chisel 30, which is rectangular in cross section, are at a distance of $<1$ mm from and come into contact with a pair of alignment rolls 34 on the sides of the alignment box 32. The relatively massive structure of the chisel 30 prevents the other sides of the chisel which are not in contact with the alignment rolls from being deflected out of line. According to another version, which is not shown here, a further pair of alignment rolls can be provided on the other sides, or the alignment rolls, preferably positioned in the middle, extend over a large part of the broad faces of the chisel.

The bearings 35 for the rolls are securely fixed to the upper side of the bottom sheet of the alignment box or housing e.g. by welding. A wiper 36 for wiping electrolyte material from the chisel is provided on the under side of the bottom sheet. This paper which extends over the whole breadth of the alignment surfaces prevents solidified electrolyte from reaching the alignment rolls when the chisel is raised. No wiper is provided on the narrow faces of the chisel 30.

In longitudinal cross section the wiper 36 is V-shaped whereby the angle $\alpha$ is usefully between 90° and 150°. The alignment housing 32 which is gas-tight in its upper part penetrates the hooding 62 over the cell, whereby, to achieve a more effective hooding of the cell, plates 64 which provide sealing are also provided.

Figure 7:
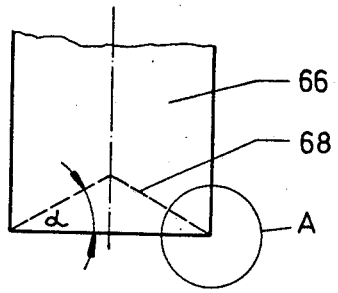
FIG. 7: Is a view of a bell-shaped chisel with conical recess.

FIG. 7 shows a cylindrically shaped chisel 66 which, instead of having a flat end face at the bottom, has a conical recess 68 there. The surfaces of this conical recess 68 and of the cylinder 66 form a cutting face which can be seen from below as being circular and which represents the punching or working face. The angle $\alpha$ formed by the faces of the conical recess 68 is preferably 15°–45°. If this angle is smaller the effect of the chisel in question as a punch diminishes progressively; angles larger than 45° are progressively less and less interesting for physical and economic reasons.

On lowering the chisel 66 a circular hole is punched in the crust of solidified electrolyte. In the process of doing this, small, outwardly directed components of force are produced. The forces developed by the faces of the conical recess are directed inwards and act therefore on that part of the crust which has to be penetrated.

Figure 8:
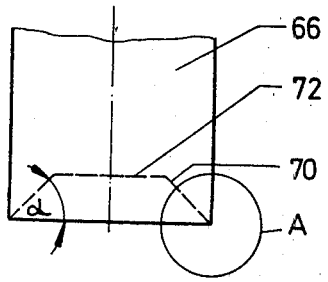
FIG. 8: Is a view of a bell-shaped chisel with blunted cone recess.

If the recess in a cylindrically shaped chisel 66 is of a blunted cone shape, as in FIG. 8, the sidewall of the blunted cone acts in the same way as the sidewall 68 of the cone in FIG. 7. The horizontal surface 72 exercises its exclusively downward directed force only after the chisel has already been pushed a distance into the crust.

Figure 9:
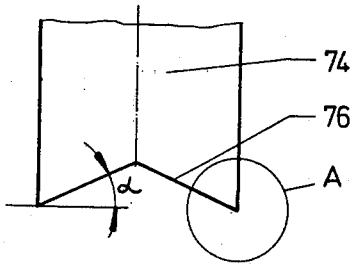
FIG. 9: Is a view of a fish-tail-shaped chisel with wedgeshaped recess.

FIG. 9 shows a, in cross section, rectangular chisel 74 which has a wedge-shaped recess 76 on its end face instead of a horizontal flat surface. The criteria which determine the choice of the angle of inclination $\alpha$ of this fish-tail shape are the same as in the previous figures. The triangular shaped recess shown in FIG. 5 can, according to another version not shown here, also be trapezium-shaped, like that in FIG. 8.

Figure 10:
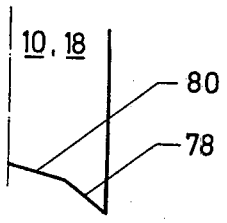
FIG. 10: Is a detail A of the shape of the edge region of the chisels shown in FIGS. 7–9.

FIG. 10 shows an enlarged view of one version of the punching or working edge. The recess, regardless of whether it is conical or wedge-shaped, runs first at a steep angle 78 and then changes over to a flatter angle 80. This has the advantage that the chisel can be pushed through the crust with less force. Only very hard, wear-resistant chisel materials can be used with this design.

Figure 11:
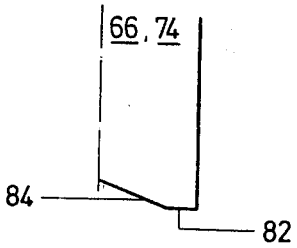
FIG. 11: Is another version of the edge region A.

A further version of working edge is shown in FIG. 11. The recess does not begin at the periphery of the chisel, but slightly nearer the center, as a result of which a horizontal surface 82 is formed around the edge region. The recess 84 begins at the inner edge of this horizontal surface, with the angle $\alpha$ preferably having the above mentioned values. This design of chisel requires more force to be applied initially when forcing its way through the crust; however, the degree of wear on the chisel is less.

Figure 12:
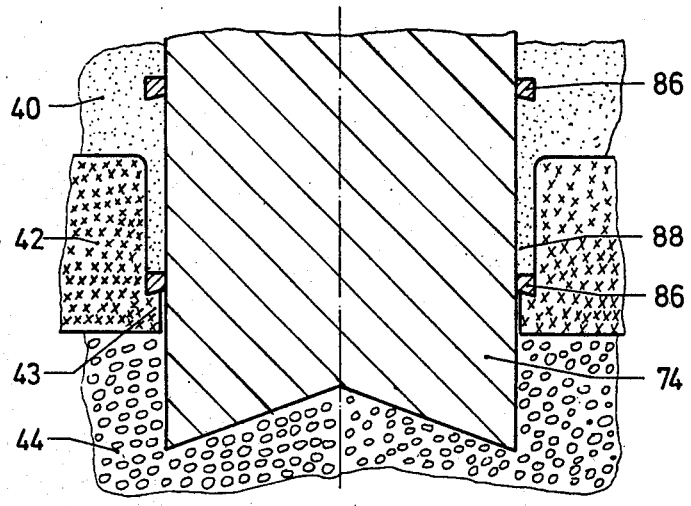
FIG. 12: Is a longitudinal section through a chisel which is rectangular in cross section and has projections provided on its narrow sidewalls.

FIG. 12 shows a chisel which in cross section is an elongated rectangle, in this case measuring 150×40 mm. The lower part of the chisel 74 is dipping into the molten electrolyte 44 i.e. it has completely penetrated the solidified melt 42. This lower part of the chisel is fish-tail-shaped. Although this shape can be used advantageously, all other suitable chisel end shapes can also be employed.

The lower pair of projections 86 have been pushed almost completely through the crust 42. This has resulted in a space 88 being created between the chisel 74 and the solidified melt 42 through almost the whole thickness of the crust. As indicated in FIG. 12, the alumina 40 lying on the crust 42 runs through this gap. This gap ensures that the chisel 74 is not jammed in the opening and after penetrating the crust can therefore be readily withdrawn again. The next time the cell is to be fed, which with automated systems takes place after a short interval of time, the chisel can be introduced into the hole without difficulty because of the extra space provided there by the projections on the chisel sidewalls. If the chisel is not exactly centered it pushes away, without any difficulty or large expenditure of force, the ridge 43 of solidified melt 42 left over after the previous feeding of the cell.

In versions not shown additional projections can be provided on the broader sidewalls of the chisel.

Also, the chisel can be lowered even further so that the lower pair of projections 86 push completely through the crust.

The lower face of the projections which faces downwards and which is about 1 $cm^2$ in cross section is undercut, preferably at an angle of up to 20°. The face of the projection inclined upwards towards the chisel sidewall causes the projections to act like teeth.

The pieces of crust and alumina pushed down into the electrolyte by the under side of the chisel are, for the sake of simplicity, not shown here.

Figure 13:
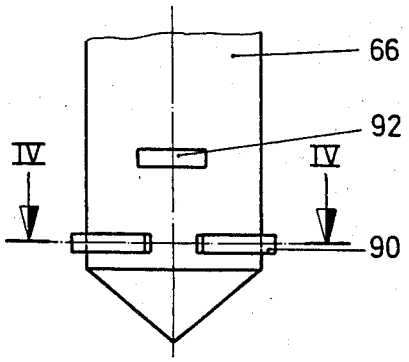
FIG. 13: Is a view of a chisel which is round in cross section and is provided with two pairs of projections at different levels on the chisel sidewall.

FIG. 13 shows a chisel 66 which is round in cross section. It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims. In this case too it holds that the conical lower part of the chisel can be of any other suitable form.

A lower pair of projections 90 extend round the greater part of the chisel periphery. Another part of projections 92 at a higher level on the other hand extend around a relatively small part of the chisel periphery.

Figure 14:
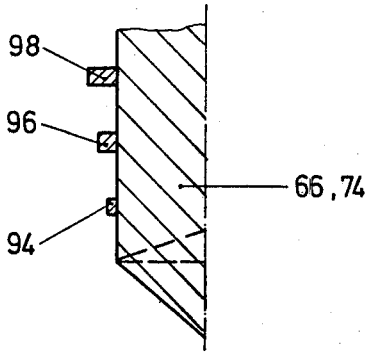
FIG. 14: Is a longitudinal view, shown partly n cross section, of a chisel with projections of various sizes on its sidewall.

Whereas the projections shown in FIGS. 12 and 13 are characterized not only by way of being elongated and horizontal but also by being uniformly broad, the projections on a chisel 66,74 shown in longitudinal cross section in FIG. 14 have different breadths. The lowest projection 94 which is the first to come into contact with the crust is narrow, the projection 96 above this broader and the uppermost projection 98 the broadest. This causes the space formed between the chisel and the crust when the crust breaker is lowered to be increased in stages from the bottom to the top.

Prefabricated projections can be attached to the chisel sidewalls by welding or bolting. The projections can also be deposited in the form of weld beads and, if desired, given their final shape by some suitable shaping process. Furthermore, the chisel and projections can belong to the same piece in that the latter are created e.g. by machining.

What is claimed is:

1. A device for point feeding alumina and additives to an electrolytic cell which comprises a support beam positioned above said electrolytic cell and a point feeding unit movably mounted on said support beam to a position freely selected along and across the entire surface area of said electrolytic cell, said point feeding unit being easily removed from said support beam and comprising:

a storage bunker having a material inlet for feeding said alumina and said additives to said storage bunker and a material outlet for removing said alumina and said additives from said storage bunker;

a run-out pipe downstream of said material outlet for feeding alumina and additives to said cell;

a dosing device positioned between said material outlet and said run-out pipe for feeding material to said run-out pipe; and a crust breaking facility releasably secured to said storage bunker, said crust breaking facility comprising a pressure cylinder system, a chisel alignment housing mounted on said pressure cylinder system and a chisel movably mounted within said chisel housing between a first and a second position for breaking the crust on said electrolytic cell.

2. A device according to claim 1 wherein said storage bunker is divided into a first compartment for at least said alumina and a second compartment for at least said additives.

3. A device according to claim 2 wherein said first compartment is larger than said second compartment.

4. A device according to claim 2 wherein said storage bunker is provided with a vertical wall for dividing said bunker into said first compartment and said second compartment.

5. A device according to claim 2 wherein said second compartment comprises a pipe within said storage bunker.

6. A device according to claim 2 including means for feeding material to said first compartment and said second compartment.

7. A device according to claim 2 wherein said material inlet comprises a pipe, said pipe having a first branch and a second branch for feeding material to said first and said second compartments respectively.

8. A device according to claim 7 wherein said first branch and said second branch are each provided with a plurality of outlets.

9. A device according to claim 8 further including means for closing off the top of said storage bunker above said pipe.

10. A device according to claim 2 wherein said material inlet comprises a pipe provided with a plurality of outlets positioned along the length thereof wherein at least the last of said plurality of outlets cooperates with said second compartment for feeding material thereto while the remaining of said plurality of outlets cooperates with said first compartment for feeding material thereto.

11. A device according to claim 10 further including means for closing off the top of said storage bunker above said pipe.

12. A device according to claim 1 wherein said runout pipe comprises a first stationary portion and a second telescopically mounted portion movable between a first and a second position.

13. A device according to claim 12 wherein said first stationary portion is secured to said dosing device.

14. A device according to claim 32 wherein said second telescopically mounted portion is secured to said crust breaking facility.

15. A device according to claim 13 wherein said second telescopically mounted portion is secured to said chisel alignment housing.

16. A device according to claim 1 wherein said pressure cylinder system comprises a positioning piston and cylinder and a working piston and cylinder, said positioning piston being secured at its upper end to said storage bunker and said positioning cylinder being secured at its lower end to the upper end of said working cylinder.

17. A device according to claim 16 wherein said alignment housing is secured to the lower end of said working cylinder and houses said chisel when said chisel is in said first position.

18. A device according to claim 17 wherein said alignment housing is provided with at least one alignment roller bearingly mounted within said housing in contact with said chisel.

19. A device according to claim 18 including wiper means mounted in said alignment housing below said roller for wiping said chisel as said chisel moves between said first and second positions.

20. A device according to claim 16 wherein said chisel is secured to the lower end of said working piston.

21. A device according to claim 1 wherein said pressure cylinder system comprises a positioning piston and cylinder and a working piston and cylinder, said positioning cylinder being secured at its upper end to said storage bunker and said positioning piston being secured at its lower end to the upper end of said working cylinder.

22. A device according to claim 21 wherein said alignment housing is secured to the lower end of said working cylinder and houses said chisel when said chisel is in said first position.

23. A device according to claim 22 wherein said alignment housing is provided with at least one alignment roller bearingly mounted within said housing at a distance of less than 1 mm from said chisel.

24. A device according to claim 23 including wiper means mounted in said alignment housing below said roller for wiping said chisel as said chisel moves between said first and second positions.

25. A device according to claim 21 wherein said chisel is secured to the lower end of said working piston.

26. A device according to claim 1 wherein said chisel is substantially cylindrical in shape and is provided on the bottom end thereof with a projection for breaking the crust on said electrolytic cell.

27. A device according to claim 26 wherein said bottom end of said chisel is provided with a recess.

28. A device according to claim 26 wherein said chisel is provided on the lower surface thereof proximate to said bottom end with at least one projection.

29. A device according to claim 28 wherein a plurality of projections are provided at different heights.

30. A device according to claim 1 wherein said chisel is substantially rectangular in cross section and is provided on the bottom end thereof with a wedge-shaped recess extending to the peripheral surface of said chisel.

31. A device according to claim 30 wherein said chisel is provided on the lower surface thereof proximate to said bottom end with at least one projection.

32. A device according to claim 31 wherein a plurality of projections are provided at different heights.

* * * * *

UNITED STATES PATENT AND TRADEMARK OFFICE

CERTIFICATE OF CORRECTION

PATENT NO. : 4,328,085

DATED : May 4, 1982

INVENTOR(S) : Hans Friedli et al.

It is certified that error appears in the above-identified patent and that said Letters Patent are hereby corrected as shown below:

On the Cover Page, the Inventors should read as follows:

--[75] Inventors: Hans Friedli; Edwin Gut; Peter Aeschbach; Gottfried Maugweiler, all of Steg, Switzerland--.

Signed and Sealed this

*Twenty-fourth* Day of *August 1982*

[SEAL]

*Attest:*

GERALD J. MOSSINGHOFF

*Attesting Officer*

*Commissioner of Patents and Trademarks*